US011466940B2

(12) United States Patent
Dinulescu et al.

(10) Patent No.: US 11,466,940 B2
(45) Date of Patent: Oct. 11, 2022

(54) GAS FLOW CONDITIONER DEVICE FOR A HEAT EXCHANGER

(71) Applicant: Apex International Holding B.V., Voorburg (NL)

(72) Inventors: Mircea Dinulescu, Voorburg (NL); Jens Kitzhofer, Duisburg (DE)

(73) Assignee: Apex International Holding B.V., Voorburg (NL)

( * ) Notice: Subject to any disclaimer, the term of this patent is extended or adjusted under 35 U.S.C. 154(b) by 41 days.

(21) Appl. No.: 16/605,235

(22) PCT Filed: Apr. 20, 2018

(86) PCT No.: PCT/NL2018/050252
§ 371 (c)(1),
(2) Date: Oct. 15, 2019

(87) PCT Pub. No.: WO2018/194457
PCT Pub. Date: Oct. 25, 2018

(65) Prior Publication Data

US 2021/0148653 A1 May 20, 2021

(30) Foreign Application Priority Data

Apr. 20, 2017 (NL) ..... 2018753

(51) Int. Cl.
*F28F 9/02* (2006.01)
*F15D 1/02* (2006.01)
*F24F 13/08* (2006.01)

(52) U.S. Cl.
CPC ..... *F28F 9/028* (2013.01); *F15D 1/025* (2013.01); *F24F 2013/088* (2013.01)

(58) Field of Classification Search
CPC . F28D 9/028; F15D 1/06; F15D 1/065; F15D 1/002; F15D 1/02; F04D 29/441;
(Continued)

(56) References Cited

U.S. PATENT DOCUMENTS 5,253,517 A * 10/1993 Molin ..... G01F 1/6842 73/114.32
5,393,587 A * 2/1995 Machida ..... F15D 1/04 428/116

(Continued)

FOREIGN PATENT DOCUMENTS

FR 2993648 1/2014
FR 3016027 A1 * 7/2015 ..... F28F 9/0268
GB 2391931 A * 2/2004 ..... F28D 7/16

*Primary Examiner* — Jianying C Atkisson
*Assistant Examiner* — For K Ling
(74) *Attorney, Agent, or Firm* — Hoyng Rokh Monegier B.V.; David P. Owen

(57) ABSTRACT

Flow conditioner device (40), for use in a heat exchanger system (10). The flow conditioner device includes a honeycomb structure (42) and a mesh (44). The honeycomb structure is configured for rectifying an incoming gas flow (26), and is formed by walls that border channels extending in a flow direction (X) from inlet apertures at a leading surface, to respective outlet apertures at a trailing surface of the honeycomb structure. The mesh is formed by a plurality of wires that extend along further directions (Y, Z) transverse to the flow direction, and which are mutually spaced to define openings. The mesh is attached directly to the honeycomb structure and abuts the second surface, and cross-sectional areas of the openings defined along the further directions vary as a function of position along at least one of the further directions.

20 Claims, 3 Drawing Sheets

(58) Field of Classification Search
CPC .. F04D 29/545; F24F 2013/088; F24F 13/082
USPC ..... 138/37–41
See application file for complete search history.

(56) References Cited

U.S. PATENT DOCUMENTS

| | | | | |
|---|---|---|---|---|
| 5,495,872 | A | 3/1996 | Gallagher | |
| 5,918,279 | A * | 6/1999 | Hecht | G01F 1/6842 73/204.21 |
| 6,112,590 | A * | 9/2000 | Rilling | F15D 1/02 73/204.21 |
| 2009/0071561 | A1* | 3/2009 | Dalrymple | F15D 1/02 138/44 |
| 2009/0218000 | A1* | 9/2009 | Pfau | F16L 55/02763 138/40 |
| 2010/0218926 | A1* | 9/2010 | Opferkuch | F28F 3/025 165/182 |
| 2012/0015598 | A1* | 1/2012 | Bagwell | F24F 13/081 454/251 |
| 2014/0338771 | A1 | 11/2014 | Brown | |

* cited by examiner

GAS FLOW CONDITIONER DEVICE FOR A HEAT EXCHANGER

TECHNICAL FIELD

The invention relates to a gas flow conditioner device for a heat exchanger, and to a heat exchanger system comprising such a flow conditioner device.

BACKGROUND ART

Flow conditioning techniques are employed in various applications, for instance in wind tunnels, flow metering, and heat exchangers. In wind tunnel design, flow conditioning techniques serve to remove secondary flow structures (e.g. swirl) that are caused by the fan or by curves in the wind tunnel, and to reduce turbulent fluctuations in transverse and along stream directions. In flow metering applications, a flow conditioner device may be positioned inside a system of ducts upstream of a measurement section, to promote uniformity of a flow velocity profile at the location of the flow measurement equipment.

In heat exchanger applications, fluid flows with fully developed, stable, and axially symmetric velocity profiles are also desirable. However, a purpose of a heat exchanger is to recoup thermal energy while using minimal power, to achieve a positive net energy gain. This requires that flow resistance and pressure drop in the fluid conduits of the heat exchanger system are kept to a minimum.

The heat exchanger as such may act as a flow conditioner for structures that are located in the fluid conduits downstream of the heat exchanger. If, however, disturbances are present in the fluid flow upstream of the heat exchanger, such disturbances will be transported into the inlet of the heat exchanger. Depending on the characteristics of the flow, a certain non-zero entrance length will be needed to attenuate disturbances and generate a fully developed and uniform velocity profile inside the fluid channels of the heat exchanger. This entrance region is connected to significant pressure losses, and in worst case velocity peaks, which may cause condensation and corrosion on the hot side of the heat exchanger. A non-uniform velocity profile across several channels at the inlet of the heat exchanger may also result in varying flow rates in the individual fluid channels, which in turn may cause a pronounced flow asymmetry at the outlet of the heat exchanger. The occurrence of such a situation is difficult to predict.

Various flow conditioning devices for homogenizing a velocity distribution in a fluid flow are known. U.S. Pat. No. 5,495,872A describes several known flow conditioner devices, among which are a perforated plate, a mesh, and tube-type, fin-type, and Zanker-type conditioners. These known devices are not optimized for heat exchanger applications.

It would be desirable to provide a flow conditioner device that is tailored to heat exchanger applications, and which allows generation of a fluid flow with a fully developed velocity profile and high uniformity, while posing a relatively low resistance to the flow.

SUMMARY OF INVENTION

Therefore, according to a first aspect of the invention, there is provided a flow conditioner (FC) device for use in a heat exchanger (HE) system. The FC device comprises a honeycomb structure and a wire mesh. The honeycomb structure is adapted to rectify an incoming gas flow, and is formed by a plurality of walls. The walls border a plurality of channels that extend in a flow direction from respective inlet apertures at a first surface, to respective outlet apertures at a second surface of the honeycomb structure. The mesh is formed by a plurality of wires, which extend along further directions transverse to the flow direction, and which are mutually spaced to define a plurality of openings. This mesh is directly attached to the honeycomb structure and abuts the second surface thereof. The cross-sectional areas of the openings defined along the further directions vary as a function of position along at least one of the further directions.

The honeycomb structure is configured to rectify (i.e. reduce or remove swirling motion from) an incoming flow of gas. By attaching the mesh directly to the honeycomb structure in an abutting arrangement on a trailing surface thereof, a compact FC device with good flow regularization performance but low flow resistance is obtained, which is particularly suitable for heat exchanger applications. The varying distribution of cross-sectional areas of mesh openings as a function along the mesh surface may be arranged so as to mitigate local inhomogeneities in the transverse velocity distribution of an incoming fluid flow, and to yield an outgoing gas flow with increased uniformity.

By using the wire mesh, a relatively high cross-sectional void fraction can be obtained. This keeps the overall flow resistance and associated pressure drop caused by the FC device low. This void fraction of the mesh is preferably in a range of 80% to 90%. Cross-sectional dimensions of the mesh openings along the further directions may for instance be 10 millimeters or less, and wire diameters may be 2 millimeters or less, e.g. between 500 micrometers and 1 millimeter.

In order to provide a good flow rectifying effect, a length of the channels of the honeycomb structure along the flow direction preferably is at least four times a transverse dimension of the channels.

In assembled state of the FC device, the mesh directly abuts the rear (i.e. outlet) surface of the honeycomb structure. The mesh and honeycomb jointly form a structural unit that can be installed into and properly aligned relative to a HE system. The mesh may be attached to the honeycomb structure by known methods, like bolting, welding, clamping, or equivalent means of attachment.

According to an embodiment, the mesh extends directly across the outlet apertures of the honeycomb structure, and is configured to generate turbulences with predetermined length scales in a regularized gas flow downstream of the FC device.

The length scales of the turbulent structures are mainly defined by the wire size (diameter) and the size of the openings in the mesh, which should be smaller than the heights of the channels in the HE device.

According to an embodiment, the cross-sectional areas of the openings of the mesh are everywhere smaller than cross-sectional areas of the outlet apertures of the honeycomb structure defined along the further directions. According to a further embodiment, the cross-sectional areas of the openings vary monotonically as a function of position along a line transverse to the flow direction.

In heat exchanger applications, inhomogeneities in the velocity distribution of the flowing gasses are frequently caused by curves in upstream flow conduits or jets from a centrifugal fan that tend to deflect towards one of the conduit walls. Such situations are relatively easy to remedy by using a mesh with a monotonic variation (i.e. increase or decrease) of the cross-sectional areas of the openings as a function of position along a line transverse to the flow direction, which is relatively easy to manufacture and install.

According to an embodiment, the wires in the mesh are arranged to form a grid with quadrilateral openings. A quadrilateral mesh is relatively easy to manufacture, and to properly align with the FC device and the HE system to provide good regularization performance. Preferably, the openings are rectangular, and more preferably square.

According to an embodiment, the walls in the honeycomb structure are arranged to form channels with quadrilateral inlet and outlet apertures. A honeycomb structure with quadrilateral channels is relatively easy to shape and combine with a plate-type heat exchanger device (of which a channel entrance side typically also has a quadrilateral shape). Preferably, the apertures are rectangular, and more preferably square.

According to an embodiment, the openings in the mesh have shapes that are congruent to the outlet apertures in the honeycomb structure. The wires in the mesh may be rotationally displaced over a non-zero angle Φ about a nominal axis along the flow direction relative to the plurality of walls in the honeycomb structure. The angle Φ may for instance be about 45°. This relative orientation is preferred if diagonal reinforcing walls are present in the honeycomb structure, and if the honeycomb structure is directly attached to (or integrated with) a channel entrance side of the HE device to provide enhanced structural support.

According to a second aspect of the invention, and in accordance with the advantages and effects described herein above, there is provided a HE system including a HE device and a FC device in accordance with the first aspect. The FC device may be positioned upstream on a channel entrance side of the HE device.

According to an embodiment, the HE device is of a plate-type. The plate-type HE device comprises heat transfer plates, which are arranged in a plate stack. Each plate extends predominantly in a plane along the flow direction and a first transverse direction. The plates are mutually spaced along a second transverse direction to define HE channels in between the plates. The wires in the mesh of the FC device may be arranged to form a grid with rectangular openings, and a portion of the wires may be oriented along the second transverse direction, to induce fine-turbulence inside the fluid channels of the HE device.

According to a further embodiment, a height of each of the first channels along the second transverse dimension ranges from 5 millimeters to 40 millimeters, for instance about 12 millimeters.

An intermediate spacing between a trailing side of the mesh and a channel entrance side of the HE device along the flow direction may be 150 millimeters or less, for instance about 100 millimeters.

The term "surface" is used herein to generally refer to a two-dimensional parametric surface region, which may have either an entirely or piece-wise flat shape (e.g. a plane or polygonal surface), a curved shape (e.g. cylindrical, spherical, parabolic surface, etc.), a recessed shape (e.g. stepped or undulated surface), or a more complex shape. The term "plane" is used herein to refer to a flat surface defined by three non-coinciding points.

BRIEF DESCRIPTION OF DRAWINGS

Embodiments will now be described, by way of example only, with reference to the accompanying schematic drawings in which corresponding reference symbols indicate corresponding parts. In the drawings, like numerals designate like elements. Multiple instances of an element may each include separate letters appended to the reference number. For example, two instances of a particular element "20" may be labeled as "20a" and "20b". The reference number may be used without an appended letter (e.g. "20") to generally refer to an unspecified instance or to all instances of that element, while the reference number will include an appended letter (e.g. "20a") to refer to a specific instance of the element.

The figures are meant for illustrative purposes only, and do not serve as restriction of the scope or the protection as laid down by the claims.

DESCRIPTION OF EMBODIMENTS

The following is a description of certain embodiments of the invention, given by way of example only and with reference to the figures.

Figure 1:
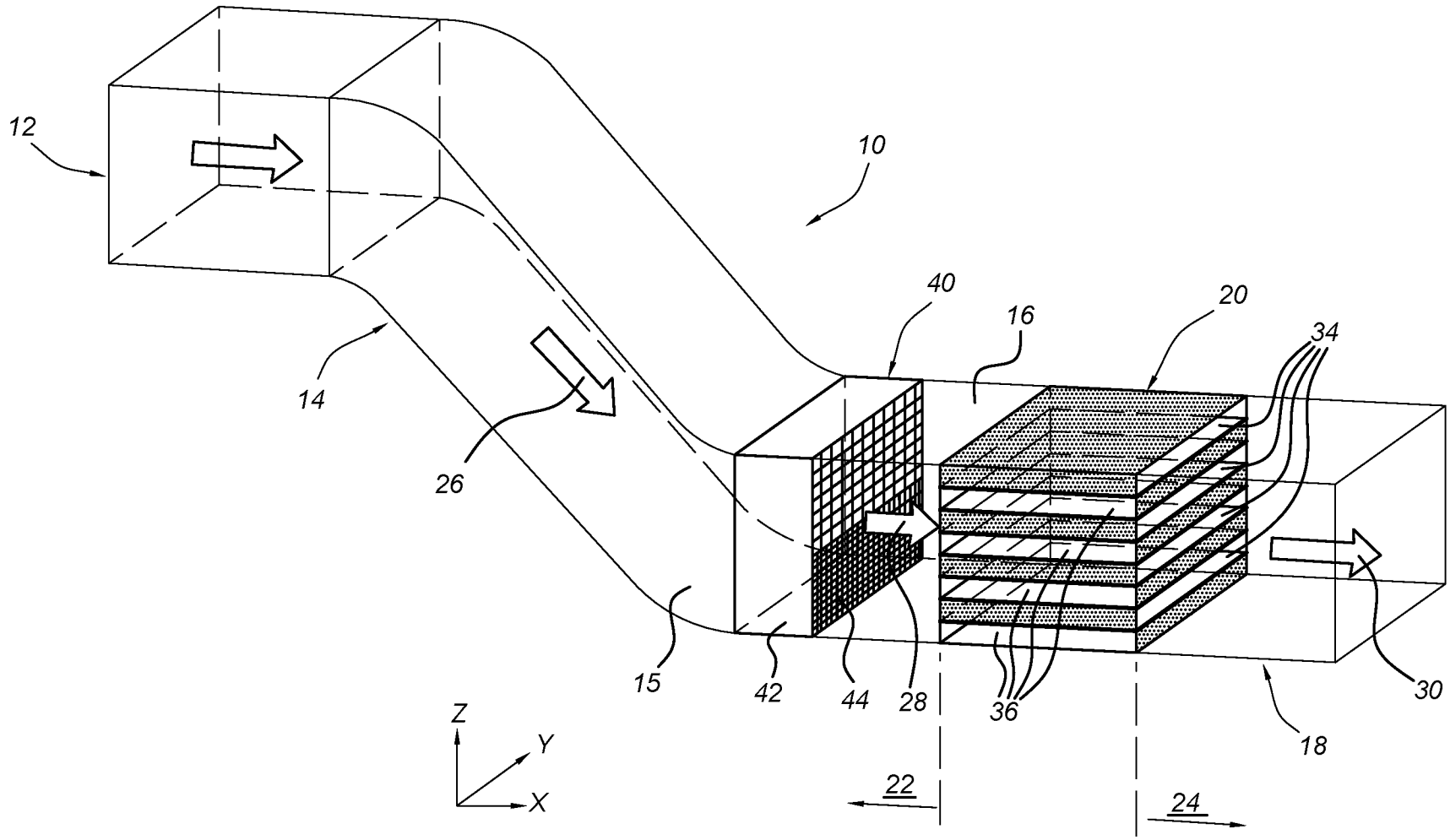
FIG. 1 schematically shows a portion of a heat transfer system, according to an embodiment.

FIG. 1 schematically shows a perspective view of a portion of a heat transfer system 10. The heat transfer system 10 includes a sequence of conduits 12, which are in fluid communication to define a passage for a flowing gas 26, 28, 30. The conduits 12 are connected to each other, and to a heat exchanger (HE) device 20, and allow the flowing gas to traverse the HE device 20.

Reference symbol X is used to indicate a longitudinal direction, corresponding with a local direction of macroscopic gas flow. This flow direction X corresponds with the local direction of a sufficiently straight portion of the conduits 12, and may vary along the system of conduits 12. The term "upstream" and "downstream" designate directions opposite to and along with the flow direction X, respectively. Reference symbols Y and Z are used to indicate (local) transversal directions that are perpendicular to X.

On an upstream region 22 of the conduits relative to HE device 20, the conduits 12 accommodate a flow conditioner (FC) device 40. This FC device 40 allows an incoming gas flow 26 to pass through, and is configured to reduce macroscopic rotation (i.e. "swirl") and promote uniformity in the velocity distribution of the incoming flow 26. Non-uniform velocity profiles may for instance be caused by a curved section (e.g. a turn) 15 in the upstream region 22 of the conduits 12. The curved section may include a slight turn as shown in FIG. 1, but may alternatively trace out a sharper curve (e.g. a 180° turn), or a sequence of turns in different directions.

The resulting flow 28 that exits the FC device 40 at the side of the intermediate conduit portion 16 is regularized (i.e. has a more uniform velocity profile and less swirl), before it enters a plurality of first channels 34 that extend through the HE device 20

Figure 2:
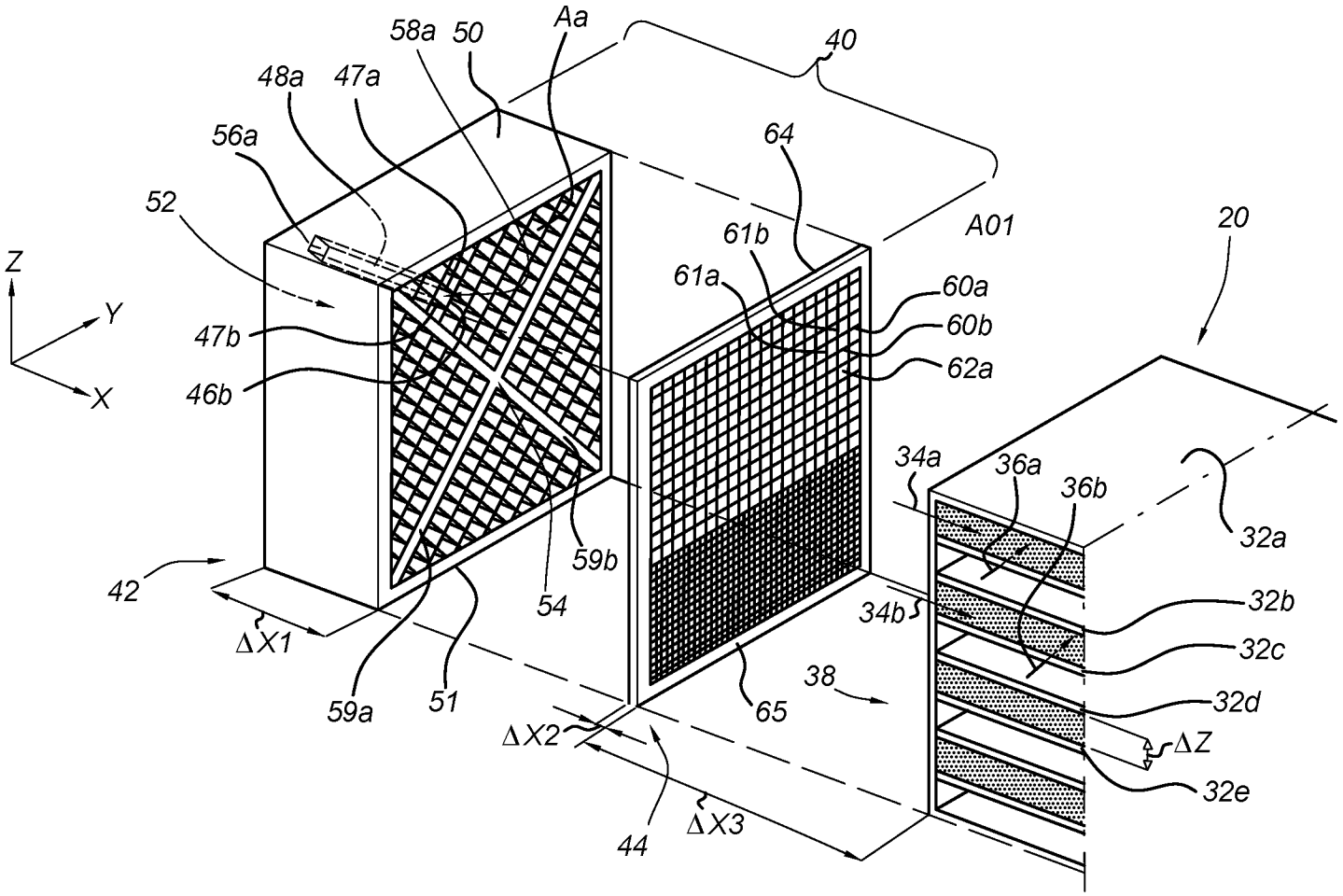
FIG. 2 presents a perspective view of a flow conditioner device, according to an embodiment.

FIG. 2 shows the exemplary FC device 40 of FIG. 1 in more detail. The flow conditioner device 40 comprises a flow rectifier 42 and a wire mesh 44. In FIG. 2, the mesh 44 is shown removed from a rear surface 54 of the flow rectifier 42, only for illustrative purposes. In an assembled state of the FC device 40, the mesh 44 is attached directly to the rear surface 54 (i.e. at an outlet side) of the flow rectifier 42, so that the flow rectifier 42 and the mesh 44 abut and form a unit. The mesh 44 may be attached to the flow rectifier 42 by known methods, like bolting, welding, clamping, or equivalent means of attachment.

The flow rectifier 42 comprises a honeycomb structure, which is configured to rectify (i.e. to reduce or even remove swirling motion from) the incoming flow of gas 26, once it passes through the honeycomb structure 42. This honeycomb structure 42 is formed by a rigid array of walls 46, 47, which extend over a characteristic length ΔX1 along the flow direction X. The walls 46-47 enclose square channels 48 from the transverse directions Y, Z. The walls 46-47 are formed by a structurally rigid and self-supporting material (e.g. carbon steel or stainless steel), and are preferably sufficiently thin (e.g. the order of 2 millimeters or less) to limit flow resistance while reducing the likelihood of deforming under operational conditions.

The channels 48 extend, from inlet apertures 56 on a leading surface 52 of the honeycomb structure 42, along the flow direction X, to outlet apertures 58 on the rear surface 54 of the honeycomb structure 42. Only one such channel 48*a*, inlet aperture 56*a*, and outlet aperture 58*a* are schematically shown in FIG. 2 for clarity. It should, however, be understood that multiple channels 48 and apertures 56, 58 are present, which define a regular two-dimensional array along the transverse directions Y, Z.

A cross-sectional area $A_a$ of each channel 48 in the transverse directions Y, Z is essentially constant along the entire length ΔX1 of the channel 48. The channel length ΔX1 is relatively long, relative to a transverse thickness of the walls 46-47, and relative to transverse channel dimensions $D_a$ (e.g. $\Delta X1>\sqrt{A_a}$). In particular, the channel length ΔX1 is at least four times the transverse dimensions $D_a$ of the channels 48, to provide good swirl reduction effects. For rectangular channels 48 with a transverse edge size $D_a$ of 50 millimeters, the channel length ΔX1 may for instance be 200 millimeters or larger.

The mesh 44 is located on the rear surface 54 of the honeycomb structure 42, and is directly attached to this rear surface 54. The honeycomb structure 42 is thus located directly upstream of the mesh 44, without space in between. The mesh 44 covers the outlet apertures 58 of the honeycomb structure 42, and is configured to generate turbulences with defined length scales in the regularized gas flow 28 that exits the FC device 40 during operation.

The honeycomb structure 42 also includes peripheral walls 50, 51, and may further include reinforced walls 59*a*, 59*b* that extend between the internal walls 46, 47 and diagonally between the peripheral walls 50, 51 to provide additional structural support to the honeycomb structure 42. The trailing surface of these reinforced walls 59 may be used as attachment region for the mesh 44.

The mesh 44 is formed by a plurality of wires 60, 61, which extend along the transverse directions Y, Z, and which are woven into a grid structure. The first wires 60 and second wires 61 enclose openings 62 in transverse directions Y, Z (again, only one such opening 62*a* is shown in FIG. 2 for clarity). In this example, the openings 62 have rectangular or square shapes, and also form a two-dimensional array in the transverse directions Y, Z.

In this example, the wires 60-61 have diameters Ø in a range from 500 micrometers to 1 millimeter. The cross-sectional void fraction of the mesh 44 is preferably in a range of 80% to 90%. Due to crossing of wires 60-61 in the mesh 44, the mesh 44 extends over a mesh length ΔX2 that is at most 2 millimeters along the flow direction X (i.e. ΔX2<<ΔX1).

Cross-sectional areas $A_o$ of the mesh openings 62 are everywhere smaller than cross-sectional areas $A_a$ of the outlet apertures 58. In the example of FIG. 2, the openings 62 are rectangular, and are smaller towards a lower edge 65 of the mesh 44. This lower edge 65 is associated with a longer outer part of the curved wall section 15 in the conduit system 12 from FIG. 1. As a result, the mesh 44 has a denser region on the lower mesh edge 65, and a courser region on an opposite mesh edge 64.

As shown in FIG. 2, the FC device 40 is positioned upstream, at a distance ΔX3 from a channel entrance side 38 of the HE device 20. In the case that the HE system 10 includes a plate-type HE device 20 with first fluid channels 34 that extend with a height ΔZ (i.e. inter-plate distance) along the second transverse direction Z in the order of 10 millimeters, this intermediate spacing ΔX3 is preferably 100 millimeters or less.

In embodiments wherein the honeycomb structure 42 includes diagonal reinforcing walls 59*a*, 59*b*, the FC device 40 may be mechanically fixed onto or integrated with the channel entrance side 38 of the HE device 20 (i.e. ΔX3≈0 millimeter), so that these walls 59 may reinforce the HE device 20 as well.

Alternatively or in addition, the generation by the mesh 44 of small-scale turbulences in the regularized gas flow 28 can be exploited to improve heat transfer characteristics of the gas flow inside the first HE channels 34 of the HE device 20. This effect becomes more noticeable if the spacing ΔX3 is reduced. In embodiments wherein the FC device 40 is mounted directly to the channel entrance side 38 of the HE device 20 (i.e. ΔX3≈0 millimeter), a second portion of the wires 61 of the mesh 44 is preferably oriented parallel with the second transverse direction Z, so that these wires 61 define fine turbulence-inducing structures that extend perpendicular to the main surfaces of the heat transfer plates 32.

Figure 3:
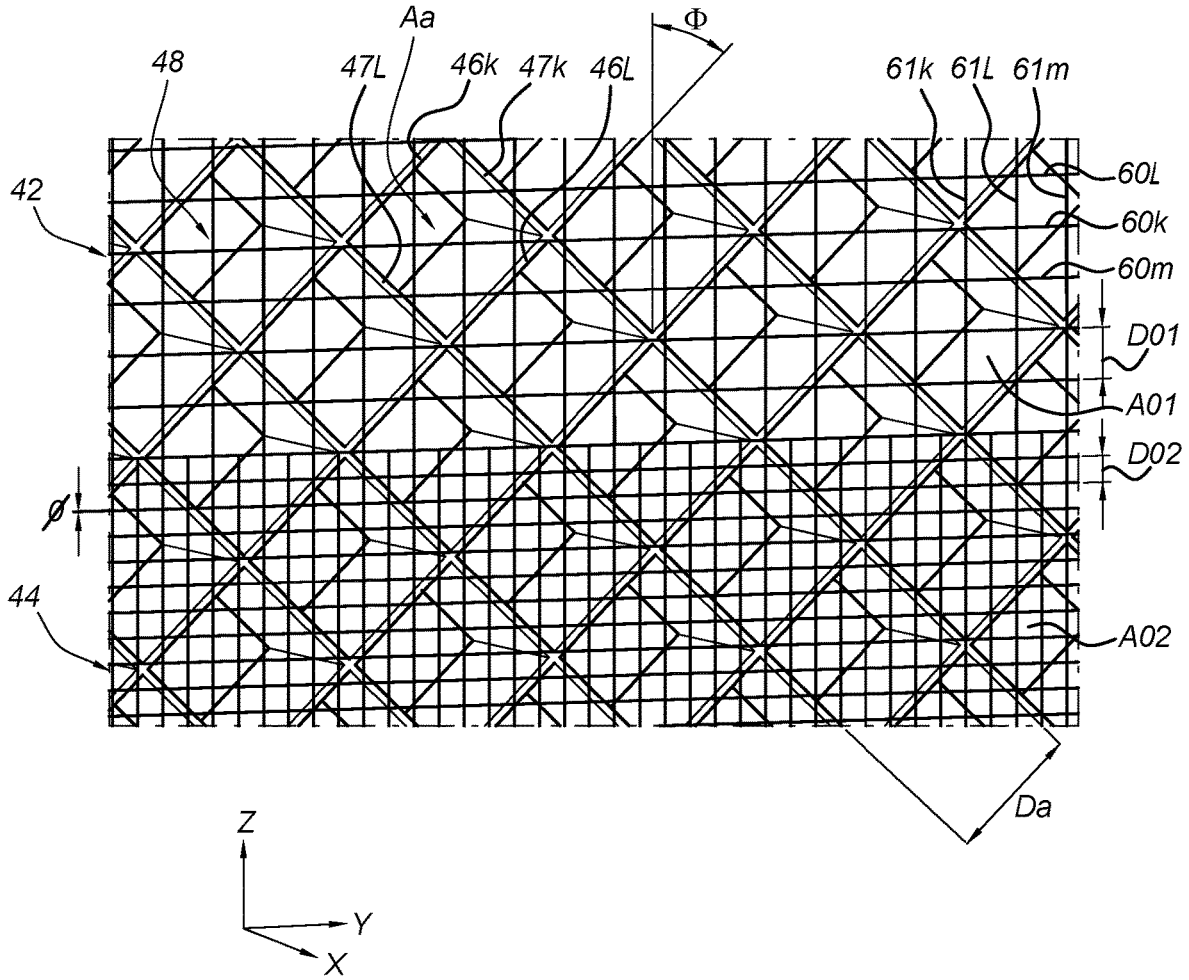
FIG. 3 shows details of the flow conditioner device from FIG. 2.

FIG. 3 shows the honeycomb structure 42 and the mesh 44 in the FC device 40 of FIG. 2 in more detail. In this example, the openings 62 in the mesh 44 have shapes that are congruent to the outlet apertures 58 in the honeycomb structure 42. The wires 60, 61 of the mesh 44 are rotationally displaced relative to the walls 46, 47 of the honeycomb structure 42 over an angle Φ≈45° about a nominal axis along the flow direction X. This relative orientation is preferred if diagonal reinforcing walls 59*a*, 59*b* are present in the honeycomb structure 42 to provide enhanced structural support.

The cross-sectional areas $A_o$ of the openings 62 are everywhere smaller than the cross-sectional areas $A_a$ of the outlet apertures 58 of the honeycomb structure 42. The mesh 44 has a non-uniform mesh size, meaning that the spacing between adjacent wires 60-61 and resulting transverse sizes $D_{o1}$, $D_{o2}$ of the openings 62 vary as a function of position along the mesh surface. As a result, the openings 62 have varying cross-sectional areas $A_{o1}$, $A_{o2}$. In this example, the mesh 44 has a stepped transition region, which divides the mesh 44 in a rectangular region with a lower mesh density i.e. larger opening area $A_{o1}$ on an upper side (associated with the upper mesh edge 64) and a rectangular region with a higher mesh density i.e. smaller opening area $A_{o2}$ on a lower side (associated with the lower mesh edge 65). Here, $A_{o1}\approx 4\cdot A_{o2}$.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. It will be apparent to the person skilled in the art that alternative and equivalent embodiments of the invention can be conceived and reduced to practice. All changes which come within the meaning and range of equivalency of the claims are to be embraced within their scope.

The openings in the wire mesh may for instance have triangular, quadrilateral, hexagonal, or other shapes.

Alternatively or in addition, the mesh may include more than just two mesh density regions, each region including mesh openings with cross-sectional areas $A_{oi}$ that differ from the other regions. Furthermore, transition(s) in the mesh from a lower mesh density region (i.e. larger opening areas $A_{o1}$) to a higher mesh density region (i.e. smaller opening areas $A_{o2}$) may be gradual instead of stepped.

In the example of FIG. 2, the cross-sectional areas $A_a$ of each channel of the honeycomb structure remained constant over the length of the channel, which implied the presence of walls with a rectangular cross-sectional shape along the flow direction. In alternative embodiments, the walls of the honeycomb structure may have an aerodynamic profile along the flow direction, which may include a rounded leading edge and/or a sharp trailing edge.

LIST OF REFERENCE SYMBOLS

10 heat exchanger system
12 conduit assembly
14 first conduit portion (e.g. supply conduit)
15 curved conduit section
16 intermediate conduit portion
18 second conduit portion (e.g. discharge conduit)
20 heat exchanger device
22 upstream region
24 downstream region
26 incoming flow
28 regularized flow
30 outgoing flow
32 heat transfer plate
34 first HE channel (e.g. longitudinal fluid channel)
36 second HE channel (e.g. transverse cross-flow fluid channel)
38 HE channel entrance
40 flow conditioner device
42 flow rectifier (e.g. honeycomb structure)
44 wire mesh
46 wall
47 further wall
48 channel
50 peripheral wall
51 further peripheral wall
52 first surface (e.g. leading/front surface)
54 second surface (e.g. trailing/rear surface)
56 inlet aperture
58 outlet aperture
59 reinforced wall
60 wire
61 further wire
62 opening
64 mesh edge
65 further mesh edge
$A_a$ aperture area
$A_o$ opening area
Φ displacement angle
X first direction (flow direction)
Y second direction (first transversal direction)
Z third direction (second transversal direction)
ΔX1 channel length
ΔX2 mesh length
ΔX3 intermediate spacing
ΔZ HE channel height
$D_a$ transverse channel edge size
$D_{o1}$ first transverse mesh edge size
$D_{o2}$ second transverse mesh edge size

The invention claimed is:

1. A heat exchanger system comprising a heat exchanger device and a flow conditioner device, the heat exchanger device being configured to recoup thermal energy from a fluid flow and comprising first heat exchanger channels for conveying a first fluid, second heat exchanger channels for conveying a second fluid separate from the first fluid, and heat transfer walls separating the first and second fluids in said first and second heat exchanger channels and adapted to transfer the thermal energy between the first and second fluids;

the flow conditioner device being positioned upstream of an entrance side of the first fluid channels, the flow conditioner comprising:

a honeycomb structure for rectifying an incoming gas flow, wherein the honeycomb structure is formed by a plurality of walls, which border a plurality of further channels that extend in a flow direction from respective inlet apertures at a first surface, to respective outlet apertures at a second surface of the honeycomb structure;

a mesh, formed by a plurality of wires, which extend along further directions transverse to the flow direction, and which are mutually spaced to define a plurality of openings;

wherein the mesh is attached directly to the honeycomb structure and abuts the second surface, wherein cross-sectional areas of the openings defined along the further directions vary as a function of position along at least one of the further directions;

and wherein the flow conditioner device does not include a wire mesh, a wire screen, or a perforated plate positioned at the first surface of the honeycomb structure, so that the inlet apertures of the further channels at the first surface remain uncovered.

2. The heat exchanger system according to claim 1, wherein the mesh extends directly across the outlet apertures of the honeycomb structure, and is configured to generate turbulences with predetermined length scales in the first fluid flowing through the first heat exchanger channels downstream of the flow conditioner device.

3. The heat exchanger system according to claim 1, wherein the cross-sectional areas of the openings of the mesh are everywhere smaller than cross-sectional areas of the outlet apertures of the honeycomb structure defined along the further directions.

4. The heat exchanger system according to claim 1, wherein the cross-sectional areas of the openings vary monotonically as a function of position along a line transverse to the flow direction.

5. The heat exchanger system according to claim 1, wherein cross-sectional dimensions of the openings defined along the further directions are 10 millimeters or less.

6. The heat exchanger system according to claim 1, wherein the walls in the honeycomb structure are arranged to form channels with quadrilateral inlet and outlet apertures.

7. The heat exchanger system according to claim 1, wherein the openings in the mesh have shapes that are congruent to the outlet apertures in the honeycomb structure, and wherein the wires in the mesh are rotationally displaced over a non-zero angle about a nominal axis along the flow direction relative to the plurality of walls in the honeycomb structure.

8. The heat exchanger system according to claim 1, wherein a cross-sectional void fraction of the mesh is in a range of 80% to 90%.

9. The heat exchanger system according to claim 1, wherein the wires of the mesh have diameters of less than 2 millimeters.

10. The heat exchanger system according to claim 1, wherein the heat exchanger device is of a plate-type, comprising heat transfer plates forming the heat transfer walls, wherein each plate extends predominantly in a plane along the flow direction and a first transverse direction, and wherein the plates are mutually spaced along a second transverse direction to define the first and second heat exchanger channels in between the plates;

wherein wires in the mesh of the flow conditioner device are arranged to form a grid with rectangular openings, and wherein a portion of the wires is oriented along the second transverse direction.

11. The heat exchanger system according to claim 10, wherein the rectangular openings are square openings.

12. The heat exchanger system according to claim 6, wherein the outlet apertures are rectangular apertures.

13. The heat exchanger system according to claim 6, wherein the outlet apertures are square apertures.

14. The heat exchanger system according to claim 9, wherein the diameters range from 500 micrometers to 1 millimeter.

15. The heat exchanger system according to claim 1, wherein a portion of the wires of the mesh is oriented perpendicular to surfaces of the heat transfer walls in the heat exchanger device, said portion of the wires being adapted to induce fine turbulences in the first fluid flowing through the first fluid channels during operation of the heat exchanger system.

16. The heat exchanger system according to claim 1, wherein the flow conditioner device is mounted directly onto the entrance side of the first fluid channels of the heat exchanger device.

17. The heat exchanger system according to claim 1, wherein the further channels have cross-sectional shapes that are constant along a length of the further channels along the flow direction so that the further channels form a regular two-dimensional array, the length of the further channels being at least four times a cross-sectional dimension of the further channels to remove swirling motion from an incoming flow of the first fluid.

18. A heat exchanger system comprising a heat exchanger device and a flow conditioner device;

the heat exchanger device being configured to recoup thermal energy from a fluid flow and comprising first heat exchanger channels for conveying a first fluid, second heat exchanger channels for conveying a second fluid separate from the first fluid, and heat transfer walls separating the first and second fluids in said first and second heat exchanger channels and adapted to transfer the thermal energy between the first and second fluids; wherein the heat exchanger device is of a plate-type, comprising heat transfer plates forming the heat transfer walls, each plate defining a planar heat transfer surface that extends along the flow direction and a first transverse direction, the plates being arranged parallel and mutually spaced along a second transverse direction to define the first and second heat exchanger channels in an interleaved arrangement in-between the plates;

the flow conditioner device being positioned upstream of an entrance side of the first fluid channels, the flow conditioner comprising:

a honeycomb structure for rectifying an incoming gas flow, wherein the honeycomb structure is formed by a plurality of walls, which border a plurality of further channels that extend in a flow direction from respective inlet apertures at a first surface, to respective outlet apertures at a second surface of the honeycomb structure;

a mesh, formed by a plurality of wires, which extend along further directions transverse to the flow direction, and which are mutually spaced to define a plurality of openings;

wherein the mesh is attached directly to the honeycomb structure and abuts the second surface, wherein cross-sectional areas of the openings defined along the further directions vary as a function of position along at least one of the further directions, the mesh defining a stepped transition that is line-shaped and divides the mesh into a first region with larger cross-sectional areas of the openings and a second region with smaller cross-sectional areas of the openings, the stepped transition extending parallel with the first transverse direction to line up with a longest cross-sectional dimension of the first heat exchanger channels on the entrance side.

19. A heat exchanger system comprising a heat exchanger device, a flow conditioner device and a conduit assembly;

the heat exchanger device being configured to recoup thermal energy from a fluid flow and comprising first heat exchanger channels for conveying a first fluid, second heat exchanger channels for conveying a second fluid separate from the first fluid, and heat transfer walls separating the first and second fluids in said first and second heat exchanger channels and adapted to transfer the thermal energy between the first and second fluids;

the flow conditioner device being positioned upstream of an entrance side of the first fluid channels, the flow conditioner comprising:

a honeycomb structure for rectifying an incoming gas flow, wherein the honeycomb structure is formed by a plurality of walls, which border a plurality of further channels that extend in a flow direction from respective inlet apertures at a first surface, to respective outlet apertures at a second surface of the honeycomb structure;

a mesh, formed by a plurality of wires, which extend along further directions transverse to the flow direction, and which are mutually spaced to define a plurality of openings; the mesh being directly attached to the honeycomb structure and abutting the second surface, wherein cross-sectional areas of the openings defined along the further directions vary as a function of position along at least one of the further directions;

wherein the conduit assembly is configured to supply the first fluid and is connected to the entrance side of the first fluid channels of the heat exchanger, the conduit assembly accommodating the flow conditioner device upstream of the entrance side and including a curved conduit section located upstream of the flow conditioner;

wherein the mesh has a transition that divides the mesh into a first region having larger cross-sectional areas of the openings and a second region having smaller cross-sectional areas of the openings, the first region being arranged on a first portion of the second surface of the honeycomb structure that corresponds to an inner bend of the curved conduit section, and the second region being arranged on a second portion of the second surface of the honeycomb structure that corresponds to an outer bend of the curved conduit section.

20. A heat exchanger system comprising a heat exchanger device and a flow conditioner device;

the heat exchanger device being configured to recoup thermal energy from a fluid flow and comprising first heat exchanger channels for conveying a first fluid, second heat exchanger channels for conveying a second fluid separate from the first fluid, and heat transfer walls separating the first and second fluids in said first and second heat exchanger channels and adapted to transfer the thermal energy between the first and second fluids;

the flow conditioner device being positioned upstream of an entrance side of the first fluid channels, the flow conditioner comprising:

a honeycomb structure for rectifying an incoming gas flow, wherein the honeycomb structure is formed by a plurality of walls, which border a plurality of further channels that extend in a flow direction from respective inlet apertures at a first surface, to respective outlet apertures at a second surface of the honeycomb structure;

a mesh, formed by a plurality of wires, which extend along further directions transverse to the flow direction, and which are mutually spaced to define a plurality of openings; wherein the mesh is attached directly to the honeycomb structure and abuts the second surface, wherein cross-sectional areas of the openings defined along the further directions vary as a function of position along at least one of the further directions;

wherein the honeycomb structure includes peripheral walls and reinforced walls extending diagonally between the peripheral walls to provide additional structural support to the honeycomb structure, and wherein the mesh is fixed to trailing edges of the reinforced walls.

* * * * *